US007614409B2

(12) United States Patent
Han et al.

(10) Patent No.: US 7,614,409 B2
(45) Date of Patent: Nov. 10, 2009

(54) DISHWASHER

(75) Inventors: Dae Yeong Han, Seoul (KR); Nung Seo Park, Incheon (KR); Seung Bong Choi, Changwon-si (KR); Sang Heon Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 554 days.

(21) Appl. No.: 11/054,337

(22) Filed: Feb. 10, 2005

(65) Prior Publication Data

US 2006/0054194 A1 Mar. 16, 2006

(30) Foreign Application Priority Data

Sep. 14, 2004 (KR) ..... 10-2004-0073398

(51) Int. Cl.
*B08B 3/02* (2006.01)

(52) U.S. Cl. ..... 134/56 D; 134/186; 137/625.16

(58) Field of Classification Search ..... 134/56 R, 134/198, 184; 137/625.16
See application file for complete search history.

(56) References Cited

U.S. PATENT DOCUMENTS

| | | | | | |
|---|---|---|---|---|---|
| 1,645,227 | A | * | 10/1927 | Cease | 134/176 |
| 1,818,595 | A | * | 8/1931 | Wilsey | 384/150 |
| 1,853,528 | A | * | 4/1932 | Zademach | 220/252 |
| 1,995,300 | A | * | 3/1935 | Fredericks | 134/58 D |
| 2,591,102 | A | * | 4/1952 | Snyder | 137/625.16 |
| 2,604,904 | A | * | 7/1952 | Flanagan | 137/625.23 |
| 2,696,219 | A | * | 12/1954 | Barksdale | 137/625.43 |
| 2,821,998 | A | * | 2/1958 | Mayhew | 137/625.11 |
| 2,906,332 | A | * | 9/1959 | Rosten et al. | 137/624.2 |
| 2,918,927 | A | * | 12/1959 | Clearman | 134/200 |
| 3,242,871 | A | * | 3/1966 | Mercer | 417/363 |
| 3,847,666 | A | * | 11/1974 | Jacobs | 134/57 D |
| 3,868,970 | A | * | 3/1975 | Ayers et al. | 137/625.46 |
| 4,398,562 | A | * | 8/1983 | Saarem et al. | 137/625.47 |
| 4,429,717 | A | * | 2/1984 | Montgomery | 137/625.47 |
| 5,331,986 | A | * | 7/1994 | Lim et al. | 134/88 |
| 5,848,601 | A | * | 12/1998 | Thies | 134/104.4 |

FOREIGN PATENT DOCUMENTS

| | | | |
|---|---|---|---|
| DE | 38 16 408 | * | 11/1989 |
| DE | 39 04 359 | * | 8/1990 |
| DE | 100 65 571 | A1 | 7/2002 |
| DE | 102 46 407 | * | 4/2003 |
| EP | 0 705 561 | | 4/1996 |
| EP | 1 101 435 | A2 | 5/2001 |
| EP | 1 543 759 | A2 | 6/2005 |
| FR | 2 431 278 | * | 2/1980 |
| JP | 7-19412 | * | 5/1995 |
| KR | 10-2004-0047017 | | 6/2004 |
| KR | 10/0457589 | | 11/2004 |

* cited by examiner

*Primary Examiner*—Frankie L Stinson
(74) *Attorney, Agent, or Firm*—McKenna Long & Aldridge LLP

(57) ABSTRACT

Dishwasher including a sump for holding washing water, a flow passage control valve mounted to the sump for controlling a flow direction of the washing water such that the washing water makes alternate washing, and a valve control device for controlling the flow passage control valve to be moved within a predetermined range of angle, thereby permitting an easy mounting of the flow passage control device which controls a flow direction of the washing water, and reduces waste of the washing water by alternately washing an upper part and a lower part.

16 Claims, 10 Drawing Sheets

DISHWASHER

CROSS-REFERENCE TO RELATED APPLICATION

This application claims the benefit of Korean Application No. P2004-0073398 filed on Sep. 14, 2004, which is hereby incorporated by reference as if fully set forth herein.

BACKGROUND OF THE INVENTION

1. Field of the Invention

The present invention relates to dishwashers, and more particularly, to a dishwasher which can control a flow of washing water conveniently, and effectively.

2. Discussion of the Related Art

In general, the dishwasher washes dishes automatically. Since the dishwasher washes, rinses, dries, and stores the dishes, the dishwasher can reduce domestic work.

In washing methods of the dishwasher, there is a shower type, and a ultrasonic type, of which shower type is used widely in home. In the shower type, warm water having detergent dissolved therein is sprayed to the dishes on racks for washing. The water is sprayed by a propeller, or nozzles in a rotating pipe.

A related art dishwasher will be described briefly, with reference to FIG. 1.

The related art dishwasher is provided with a water holding part 1, and upper, and lower washing parts 3, and 4, for spraying water introduced thereto from the water holding part, respectively.

The water holding part 1 has a main water collecting part 1*a* for receiving water from an outside of the dishwasher, and collecting and discharging contaminated water after washing the dishes. Over the main water collecting part 1*a*, there is a channel forming part 1*b* having flow passages formed therein for moving washing water circulating within the dishwasher to the upper, and lower washing parts. The channel forming part 1*b* has a filtering part 1*c* connected thereto for filtering contaminants from the washing water.

The motor 2 provides power for driving a washing pump for supplying the washing water to the upper and the lower washing parts 3, and 4 during dishwashing, or driving a discharge pump for discharging the washing water after finish of the washing.

The upper, and lower washing parts 3, and 4, places for washing the dishes actually, are connected to the water holding part with connection pipes. Spray arms (not shown) of the upper, and lower washing parts 3, and 4 spray the washing water supplied from the water holding part 1, to wash the dishes.

The steps of a process for operating the related art dishwasher will be described.

After placing dishes intended to wash in the rack, a cycle the user desires is entered. Then, the washing water is filled in the main water collection part of the dishwasher through a water supply valve connected to an outside of the dishwasher. Then, the dishwasher puts a heater into operation, to heat the washing water, and puts the motor into operation, to drive the washing pump. Then, the heated washing water moves to the upper, and lower spray arms through the connection pipes by the washing pump. The washing water reached to the spray arms is sprayed through the spray nozzles, and removes contaminants from a surface of the dish.

The contaminants and the washing water removed from the dishes after the dishwashing are collected to the main collection part. If a level of contamination of the washing water is higher than a certain level, the dishwasher discharges the contaminated washing water through the discharge pump, and has fresh water received from an outside of the dishwasher. However, if the level of the contamination is below the certain level, the dishwasher cleans the washing water collected at the main collection part, and supplies to the upper and lower spray arms by using the washing pump, again. The washing water collected at the main collection part after finish of washing is discharged to an outside of the dishwasher by the discharge pump, together with the contaminants.

In the meantime, the related art dishwasher is provided with a three-way valve for controlling a direction of the washing water, mostly a solenoid valve. The solenoid valves, opened/closed automatically by an electro-magnetic principle, are widely used in automation of complicated machines, or safety devices.

However, the related art dishwasher has the following problems.

First, the related art dishwasher supplies the washing water to the upper, and lower spray arms at the same time when washing is performed at the upper washing part and the lower washing part. According to this, it is liable to use the washing water excessively, to fail effective control of the washing water.

Second, the related art dishwasher has a complicated mounting structure of a flow control device which controls a direction of the washing water.

SUMMARY OF THE INVENTION

Accordingly, the present invention is directed to a dishwasher that substantially obviates one or more problems due to limitations and disadvantages of the related art.

An object of the present invention is to provide a dishwasher, in which a flow direction of washing water is controlled effectively, for preventing wasting of the washing water.

Another object of the present invention is to provide a dishwasher, in which a flow passage control device has a simple mounting structure for controlling a flow direction of the washing water.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher includes a sump for holding washing water, a flow passage control valve mounted to the sump for controlling a flow direction of the washing water such that the washing water makes alternate washing, and a valve control device for controlling the flow passage control valve to be moved within a predetermined range of angle.

Preferably, the flow passage control valve includes an upper plate, a lower plate spaced from, and positioned under the upper plate, ribs connected between the upper plate and the lower plate, and a valve coupling boss for coupling to the valve control device.

In more detail, at least one of the ribs preferably has a width greater than a width of a main flow passage through which the washing water flows.

Preferably, the valve control device includes a motor for driving the flow passage control valve, and a switch and a cam for controlling the motor.

Preferably, the cam has a shaft pass through hole for passing through of a motor shaft of the motor. Preferably, the cam includes a first circumferential surface and a second circumferential surface to be brought into contact with a lever of the switch. More preferably, the first circumferential surface has a radius smaller than a radius of the second circumferential surface.

Preferably, the motor shaft is passed through the shaft pass through hole, joined with the valve coupling boss, such that the motor shaft rotates as a unit with the cam and the flow passage control valve.

Preferably, the dishwasher further includes a packing member between the flow passage control valve and the valve control device.

Preferably, the packing member has a coupling boss pass through hole for placing the valve coupling boss therein, and pleats in a contact surface thereof with the packing member.

Preferably, the sump includes a valve mounting part on an inside for mounting the flow passage control valve thereon, there is a recess on an inside of the valve mounting part for placing the packing member therein.

Preferably, the recess is formed stepped down from the valve mounting part, and has a hole therein for placing the valve coupling boss therein.

Preferably, the dishwasher further includes a housing mounting groove at an outer circumference of the valve mounting part having a shape in complementary to a lower housing over the sump.

Preferably, the sump includes a motor mounting part projected from an outside surface of the sump for mounting the motor thereon. More preferably, the motor mounting part is adjacent to the switch mounting part for mounting the switch thereon.

Preferably, the motor mounting part includes reinforcing ribs for increasing strength of an outside of the sump, and motor fastening bosses for securing the motor to the sump.

Preferably, the reinforcing ribs include rim supporting walls projected from the sump to an outside thereof, and a middle supporting wall connected between the rim supporting walls.

Preferably, the motor fastening bosses are at predetermined positions of the reinforcing ribs, and projected longer than projection lengths of the reinforcing ribs.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
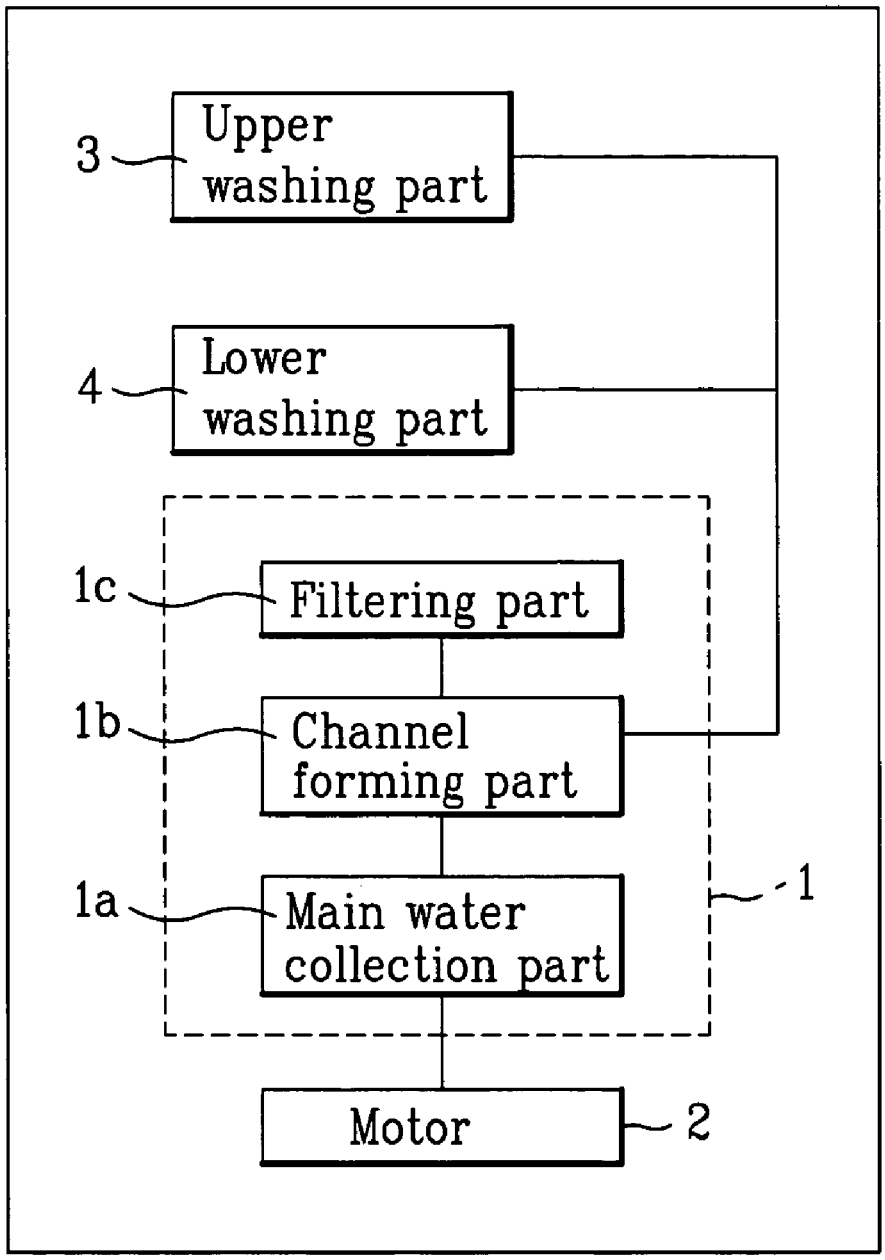
FIG. 1 illustrates a block diagram of a related art dishwasher system.
Figure 2:
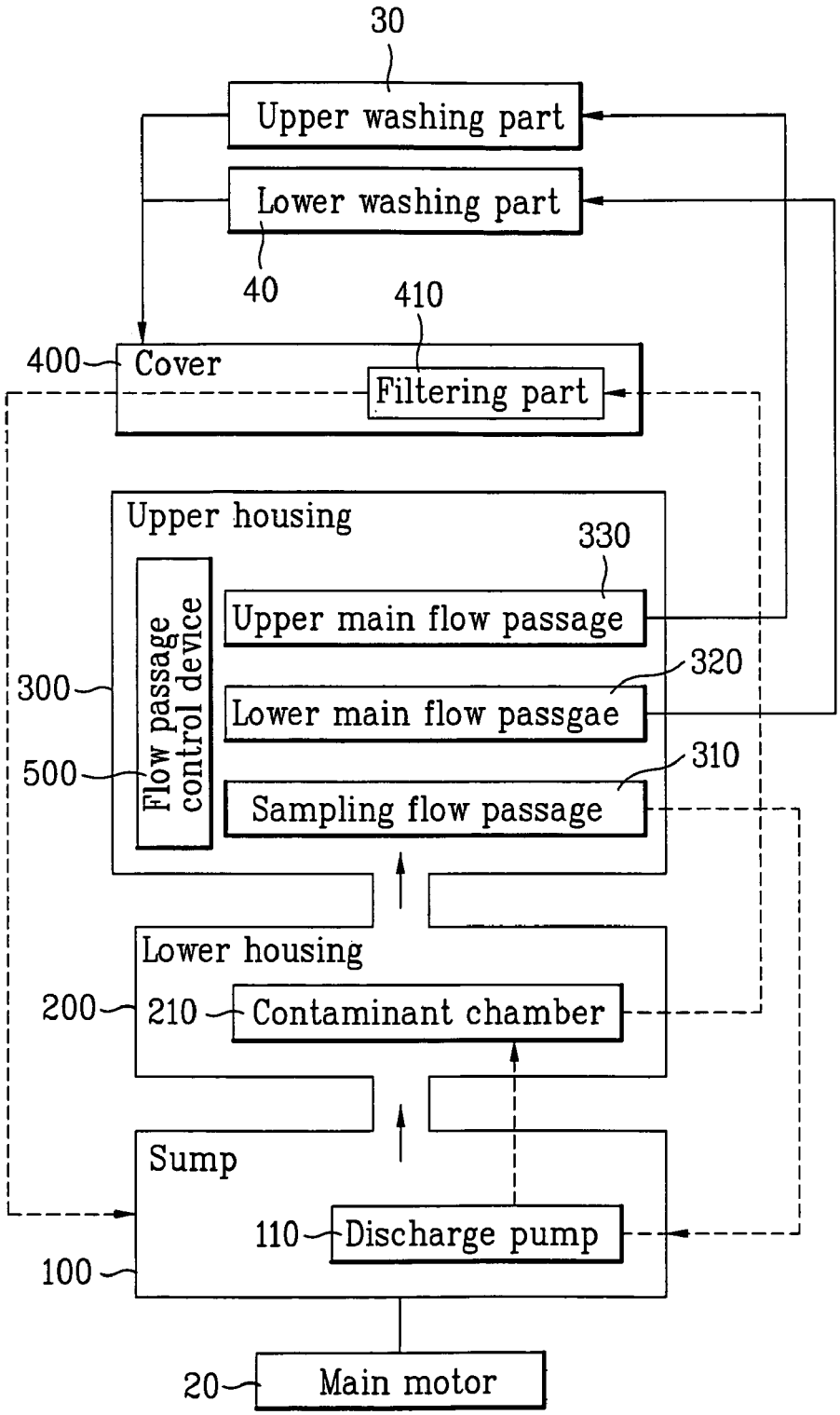
FIG. 2 illustrates a block diagram of a dishwasher system in accordance with a preferred embodiment of the present invention.

Flow paths of washing water in the dishwasher of the present invention will be described, with reference to FIG. 2.

At a lower portion of the dishwasher, there is a sump 100 for holding the washing water, and over the sump 100, there is a lower housing 200 having a contaminant chamber 210 formed therein. Over the lower housing 200, there is an upper housing 300 having flow passages of the washing water formed therein, and over the upper housing 300, there is a cover 400 for covering the upper housing.

The washing water is moved from the sump 100 to the upper housing 300 through the lower housing 200 by the washing pump. Then, by the flow passage control device 500, the washing water is moved to the upper washing arm through an upper main flow passage 330 in the upper housing 300, and to the lower washing arm through the lower main flow passage 320.

A portion of the washing water is moved to the discharge pump 110 through a sampling flow passage 310. The washing water passed through the discharge pump 110 is introduced into the contaminant chamber 210 in the lower housing 200, and filtered by a filtering part 410 in the cover 400. The washing water filtered at the filtering part 410 is collected to the sump 100, again.

Different from the related art dishwasher, the dishwasher of the present invention has the sampling flow passage 310 for measuring a level of contamination and filtering. Because the sampling flow passage 310 is connected to the contaminant chamber 210 through the washing pump and the discharge pump 110, a pressure on the filtering part 410 becomes lower by the washing pump. According to this, the filtering part 410 in the cover 400 is not liable to be blocked by the contaminants.

Figure 3:
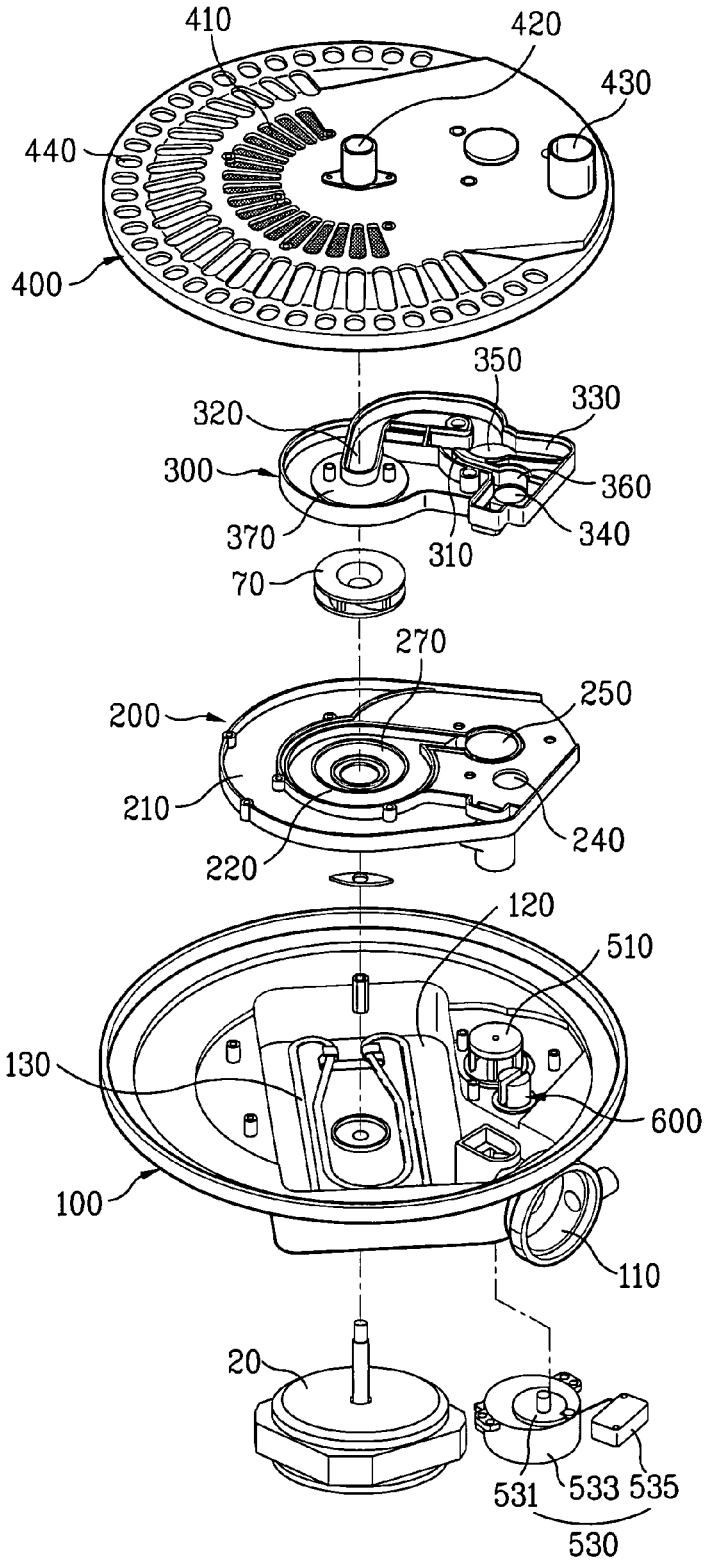
FIG. 3 illustrates an exploded perspective view of key parts in FIG. 2.

The water holding device of the dishwasher in FIG. 2 will be described in detail, with reference to FIG. 3.

Under the water holding device, there is a main motor 20 for providing power to the dishwasher, and over the main motor 20, there is a sump 100 having a washing water collection part 120 formed therein for collecting the washing water.

Over the sump 100, there is a lower housing having a contaminant chamber 210 formed therein, and, over the lower housing 200, there is an upper housing 300 having a flow passage for the washing water formed therein. Moreover, over the upper housing 300, there is a cover 400 for filtering, and returning the washing water to the sump 100, again.

There is a heater 130 in the sump 100. It is preferable that the heater 130 is always submerged in the washing water while the dishwasher is in operation. The heater 130 heats the washing water to an appropriate temperature, for easy washing of the dishes.

On an underside of the sump 100, there are the main motor 20, and a valve control device 530 for controlling a flow passage control valve, and a discharge pump 110 at one side of outside thereof. The main motor and the valve control device may be mounted on one side of outside of the sump, and the discharge pump may be mounted on the underside of outside of the sump.

Formed in the lower housing 200, there is a first pass through hole 240 for passing through of a contamination level measuring sensor 600 for measuring a contamination level of the washing water, and a contaminant chamber 210 for collecting the washing water from the contamination level measuring sensor 600 and the discharge pump 110.

At the center of the lower housing 200, there is an impeller holding part 270 for holding an impeller 70, and on an outside of the impeller holding part 270, there is an introduction flow passage 220 for introduction of the washing water to the flow passage control valve 510 by using the impeller. There is a second pass through hole 250 in a portion of the lower housing 200 the introduction flow passage 220 is connected thereto for passing through of the flow passage control valve 510.

The upper housing 300 has an impeller cap 370 for receiving an upper portion of the impeller 70, and a second pass through hole 350 for passing through of the flow passage control valve 510. The upper housing 300 also has an upper main flow passage 330 connected to the second pass through hole 350 for guiding the washing water to the upper washing arm, a lower main flow passage 320 for guiding the washing water to the lower washing arm, and a sampling flow passage 310 for guiding the washing water to the discharge pump 110.

In the sample flow passage, there is an enlarged flow passage part 360 having a first pass through hole 340 for passing through of the contamination level measuring sensor. Though it is preferable that the upper housing and the lower housing are separable type, they may be a unit type.

The impeller 70 between the upper housing 300 and the lower housing 200 is coupled to the main motor 20 with a shaft. The impeller 70 is rotated by the main motor 20, for introduction of the washing water from the washing water collection part 120 of the sump 100 to the introduction flow passage 220.

The washing water passed through the introduction flow passage 220 is divided into the upper main flow passage 330, the lower main flow passage 320, and the sampling flow passage 310.

The flow passage control device includes a flow passage control valve 510 for controlling a flow direction of the washing water, a valve control device 530 for controlling the flow passage control valve 510, and a packing member (not shown) between the flow passage control valve and the valve control device. The flow passage control valve 510 and the packing member are mounted on an inside of the sump, and the valve control device 530 is mounted on an underside of an outside of the sump.

The cover 400 has a filtering part 410 at a center for filtering, and recovery holes 440 of predetermined forms in a periphery for recovering the washing water filtered at the filtering part 410 to the sump 100, again.

The cover 400 has an upper arm connection part 430 for serving as a passage through which the washing water moves from the upper main flow passage to the upper spray arm, and a lower arm connection part 420 for serving as a passage through which the washing water moves from the lower main flow passage to the lower spray arm. The cover 400 may be joined to the upper housing 300 as one unit by thermofusion, or mounted individually and held together with fastening means.

Figure 4:
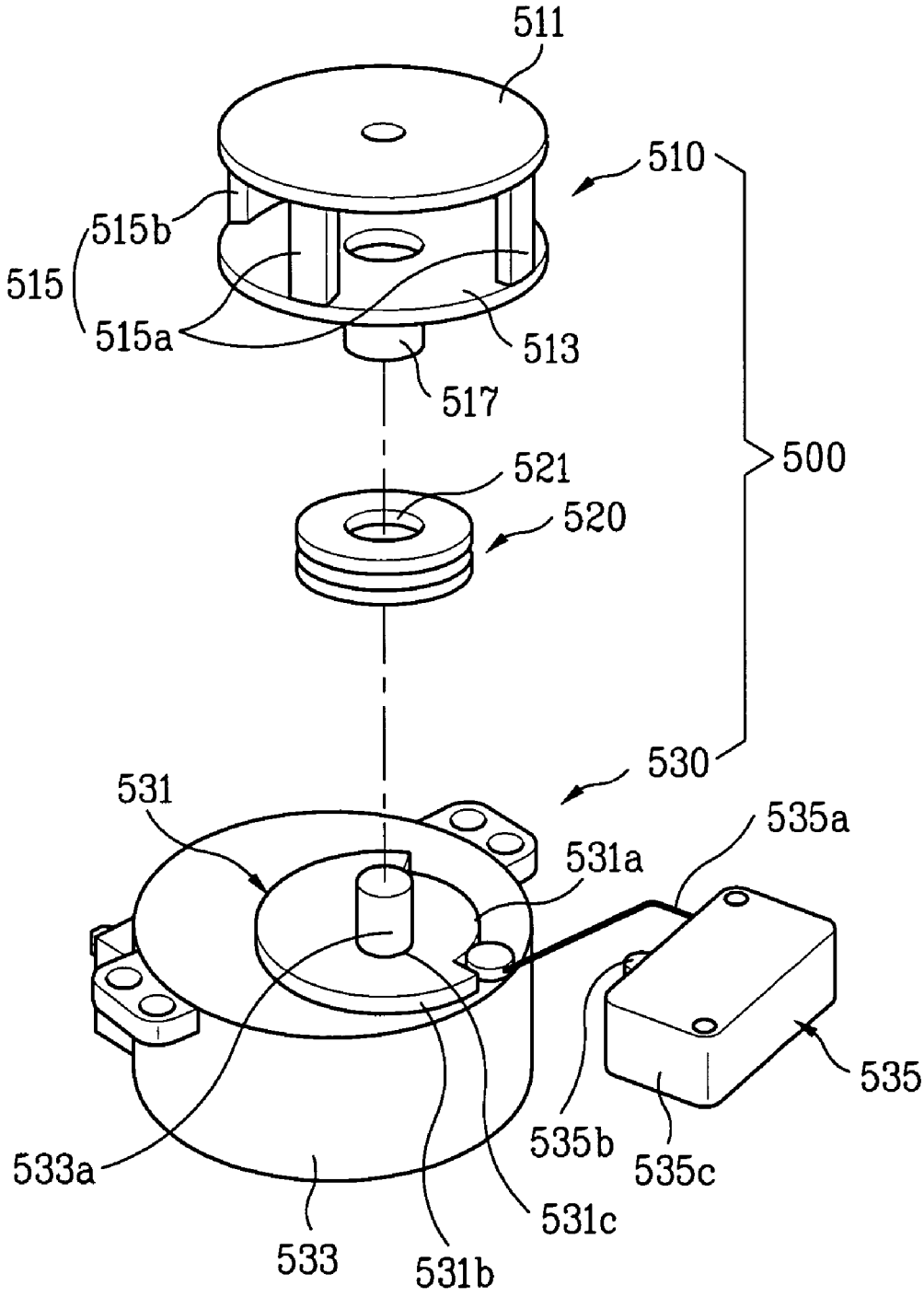
FIG. 4 illustrates an exploded perspective view of a flow passage control device in accordance with a preferred embodiment of the present invention.

The structure of the flow passage control device in FIG. 3 will be described in detail, with reference to FIG. 4.

The flow passage control device 500 includes a flow passage control valve 510 for controlling a flow direction of the washing water, a valve control device 530 for controlling the flow passage control valve 510, and a packing member 520 between the flow passage control valve and the valve control device. The flow passage control valve 510 and the packing member 520 are mounted on an inside of the sump, and the valve control device 530 is mounted on an underside of an outside of the sump.

The flow passage control valve 510 includes an upper plate 511 forming an upper part of the valve, a lower plate 513 spaced from, and positioned under the upper plate, ribs 515 connected between the upper plate and the lower plate, and a valve coupling boss 517 for coupling to the valve control device.

The upper plate 511 and the lower plate 513 are opposite to each other, and have same sized disk shapes. The upper plate 511 and the lower plate 513 are connected with the ribs 515. The rib 515 has one main rib 515*b* and two subribs 515*a*.

The rib 515 may has at least one rib. It is preferable that the main rib 515*b* has a width greater than a width of the upper main flow passage of the upper housing, or a width of the lower main flow passage (not shown) of the upper housing, and the width of the subrib 515*a* has a width smaller than the width of the main rib.

There is a valve coupling boss 517 at a center for coupling to the valve control device 530. That is, the valve coupling boss 517 has the motor shaft 533*a* inserted therein. The valve coupling boss 517 has a length of cylindrical shape in communication with an inside space of the flow passage control valve 510. The shape is not limited to this, but any shape is viable as far as the shape can fit in the motor shaft 533*a*.

The valve control device 530 includes a motor 533 for driving the flow control valve 510, and a switch 535 and a cam for controlling the motor.

The motor 533 is preferably reversible, and a synchronous motor which rotates at a constant speed at a frequency regardless of load.

The cam 531 is mounted on the motor 533 such that a rotating shaft of the cam and the rotating shaft of the motor are positioned in the same axis. The cam has a shaft pass through hole 531*c* in complementary to the motor shaft.

As the motor shaft 533*a* is joined to the shaft pass through hole 531*c*, the cam 531 is rotatable with the motor shaft 533*a*. Though the motor shaft and the cam may be joined by forced fit, they may be joined by screw fastening.

The cam 531 includes a first circumferential surface 531*a* having a small radius, and a second circumferential surface having a great radius. The first circumferential surface 531*a* and the second circumferential surface 531*b* are stepped to each other, and it is preferable that a central angle of the second circumferential surface is greater than a central angle of the first circumferential surface.

The switch 535 includes a body 535*c*, a lever 535*a* extended from one side of the body, and a projection 535*b* for being brought into contact with/brought away from the contact with, the lever 535*a*.

The body 535*c* forms a body of the switch, and the lever at one side of the body 535*c* is in contact with a circumferential surface of the cam 531. The projection 535*b* at one side of the body 535*c* is brought into contact with the lever 535*a* depending on a moving direction of the cam 531.

That is, the switch 535 is brought into contact with/brought away from the contact with the cam, to turn on/off the motor. It is preferable that the switch 535 is a microswitch.

The packing member 520 is mounted between the flow passage control valve 510 and the valve control device 530, and seals the valve control device 530 for preventing infiltration of water therein.

The packing member 520 has pleats at a contact surface with the flow passage control valve 510, for making close contact with the flow passage control valve. The packing member 520 has a coupling boss pass through hole 521 for passing through of the valve coupling boss 517. It is preferable that the packing member is formed of an elastic material, and, more preferably of a synthetic rubber.

A state in which the washing water is introduced into the lower washing arm by the flow passage control device will be described with reference to FIG. 5.

When the user presses an enter key for starting dishwashing, the flow passage control valve 510 rotates around the center axis of the flow passage control valve by the motor. When the main rib 515*b* of the flow passage control valve comes to a position at which the main rib 515*b* closes the upper main flow passage 330 in the upper housing 300, the motor stops.

According to this, the washing water introduced through the introduction flow passage 220 can flow only to the lower main flow passage 320 and the sampling flow passage 310. That is, the washing water flows only to the lower washing arm.

Figure 5:
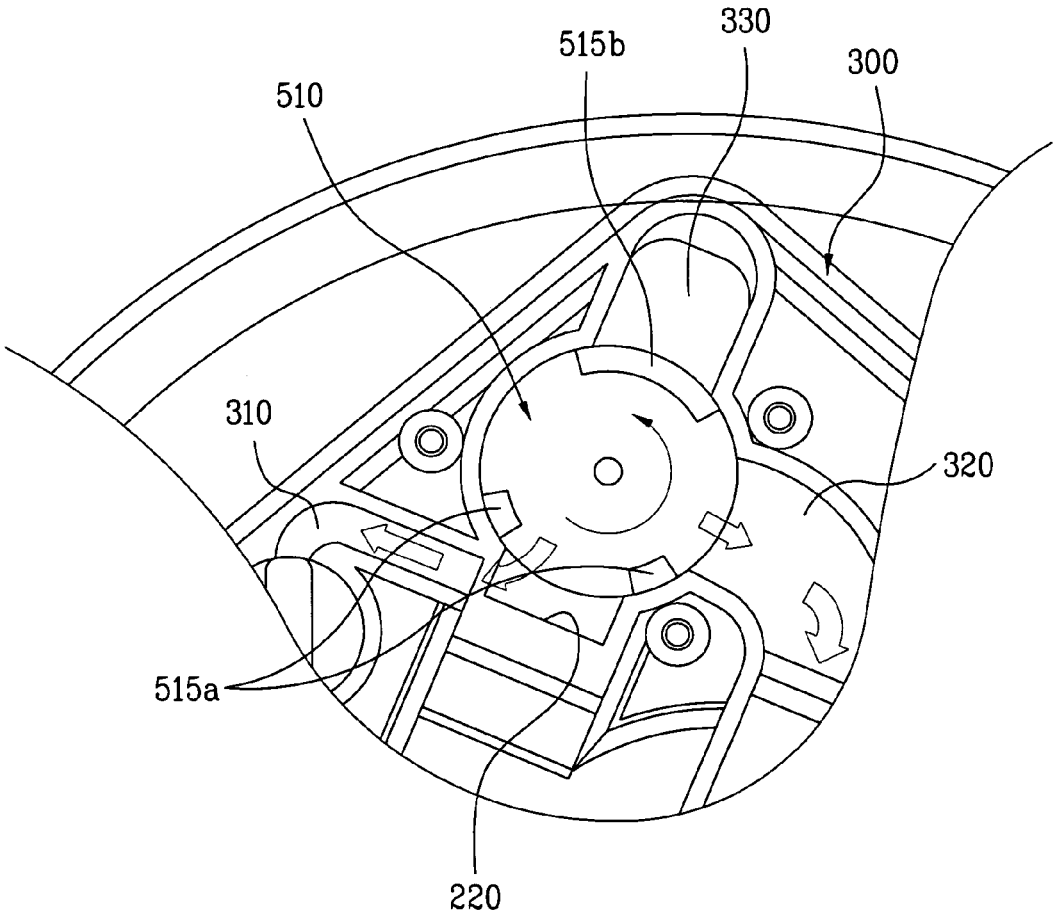
FIG. 5 illustrates a plan view showing a state of a flow passage control valve at the time of washing at a lower washing part of a dishwasher in accordance with a preferred embodiment of the present invention.
Figure 6:
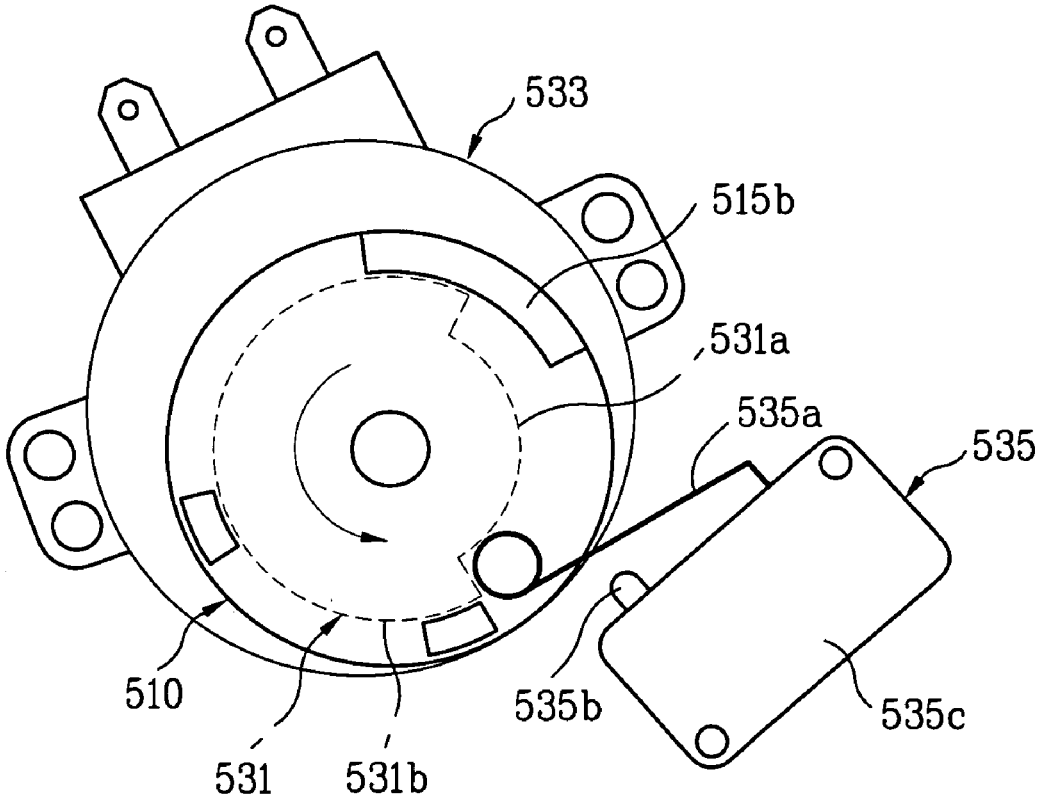
FIG. 6 illustrates a plan view showing an operation state of a flow passage control device at the time of washing at a lower washing part of the dishwasher.

A state of operation of the valve control device in a case the washing water flows to the lower washing arm as shown in FIG. 5 will be described, with reference to FIG. 6.

When the flow control valve 510 rotates by the motor 533, the cam 531 on an upper part of the motor also rotates. In this instance, an end of the lever 535*a* of the switch moves along the second circumferential surface 531*b* of the cam.

After a certain time period is passed, at the moment the lever 535*a* comes into contact with the first circumferential surface 531*a* of the cam, the motor 533 stops, and the flow passage control valve 510 moves no more. In this instance, the main rib 515*b* at the flow passage control valve 510 is at a position where the main rib 515*b* closes the upper main flow passage. That is, the washing water is supplied to the lower spray arm, only.

If it is a case when the user gives an order to wash a lower part, the motor 533 and the flow passage control valve 510 maintain the stopped states, continuously. However, if it is a case when the user gives an order for washing both the upper part and the lower part, the motor 533 is made to come into operation after pass of a preset time period by a control part (not shown) of the dishwasher, again.

Then, the motor 533 rotates the flow passage control valve 510 until the main rib 515*b* of the flow passage control valve comes to a position where the main rib 515*b* closes the lower main flow passage in the upper housing. That is, the washing water is supplied only to the upper spray arm.

Thus, in washing a lower part and an upper part, the washing water is supplied to the upper spray arm and the lower spray arm, not at the same time, but alternately with preset regular time intervals.

At the end, a supply rate of the washing machine in a case of alternate washing of the upper part and the lower part is half of a case when the upper part and the lower part are washed at the same time. However, the present invention is not limited to this, but the upper part washing and the lower part washing can be performed at the same time.

Figure 7:
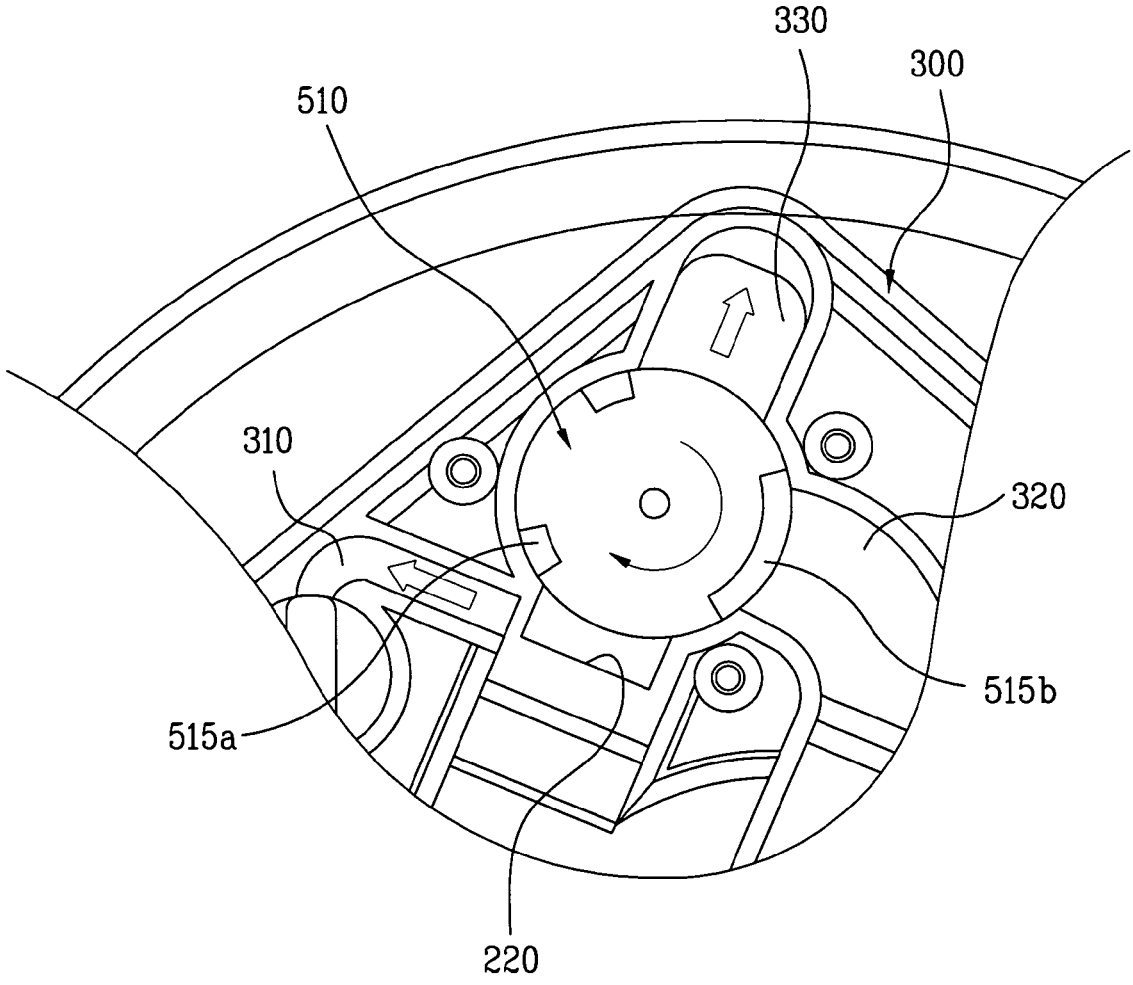
FIG. 7 illustrates a plan view showing an operation state of a flow passage control device at the time of washing at an upper washing part of the dishwasher.
Figure 8:
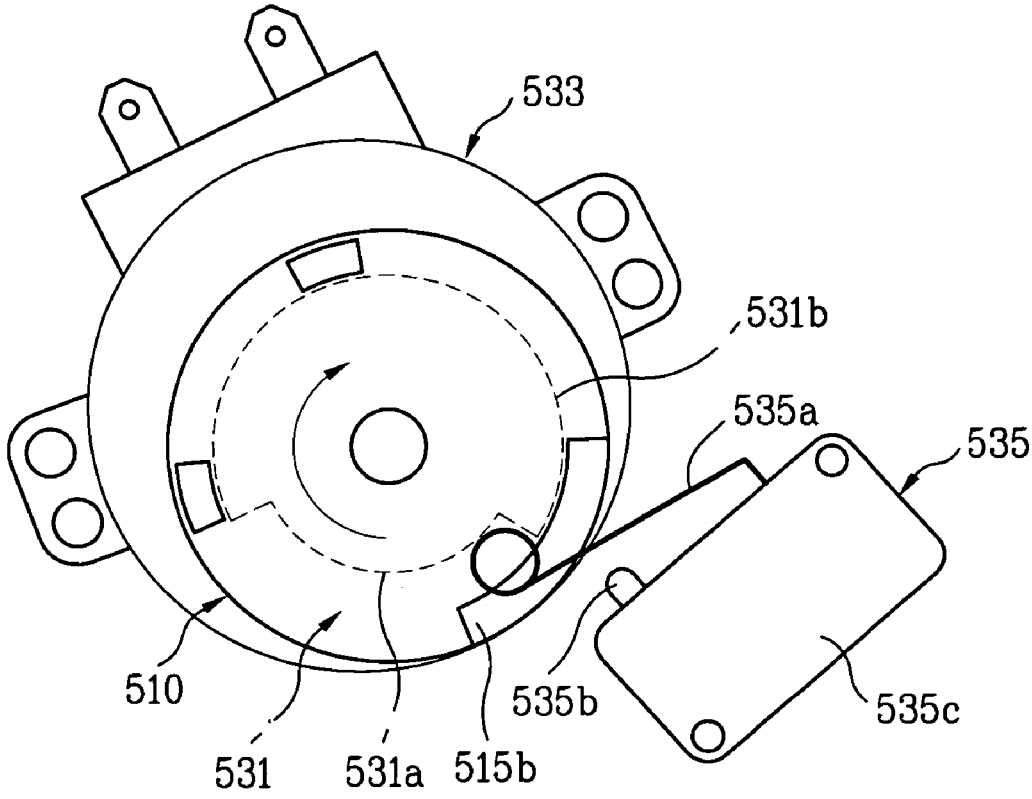
FIG. 8 illustrates a plan view showing an operation state of a flow passage control device at the time of washing at an upper washing part of the dishwasher.
Figure 9:
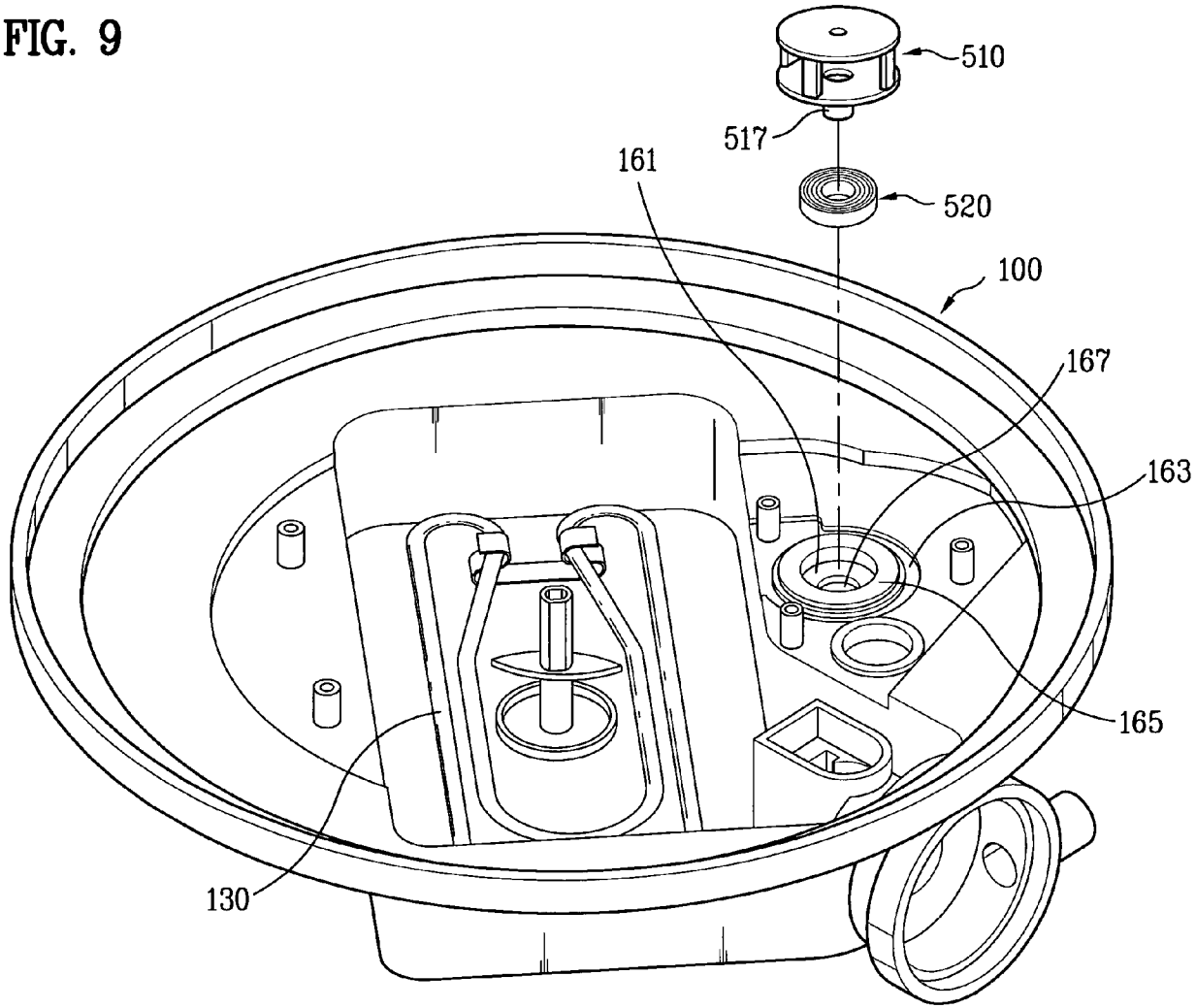
FIG. 9 illustrates a perspective view of an inside structure of a sump having a flow passage control valve mounted thereon.

A state will be described with reference to FIGS. 7 and 8, in which the washing water is introduced into the upper washing arm by the flow passage control device.

Alike the case when the washing water flows to the lower washing arm, when the main rib 515*b* of the flow passage control valve 510 comes to a position where the main rib 515*b* closes the lower main flow passage 320, the motor 533 which controls the flow passage control valve 510 stops. In this instance, the end of the lever 535*a* of the switch is positioned on the first circumferential surface of the cam.

Then, when the motor 533 is driven again, the end of the lever 535*a* moves on the second circumferential surface 531*b*, when the lever 535*a* is in contact with the projection 535*b*. Then, the flow passage control valve 510 rotates until the lever 535*a* is positioned on the first circumferential surface 531*a* of the cam. That is, the motor 533 is controlled by the cam 531 and the switch 535, and the flow passage control valve 510 is controlled by the motor.

However, the control of the flow passage control valve 510 is not limited to this, restriction means which restricts rotation of the flow passage control valve only to a predetermined section may be mounted to the sump or the housing.

A structure in which the flow passage control valve and the packing member are mounted on an inside of the sump of the dishwasher will be described.

The sump 100 has a valve mounting part 165 on one side of upper part of an inside of the sump 100, for mounting the flow passage control valve 510. Inside of the valve mounting part, there is a recess 161 stepped down from the valve mounting part, for placing a packing member 520 therein.

At a center of the recess 161, there is a hole 167 for placing the valve coupling boss 517 of the flow passage control valve therein. At an outer circumference of the valve mounting part 165, there is a housing mounting groove 163 in complementary to the lower housing over the sump.

However, the shapes of the recess and the groove are not limited to above, but any shapes are viable as far as the shapes are complementary to the shapes of the packing member and the lower housing.

Figure 10:
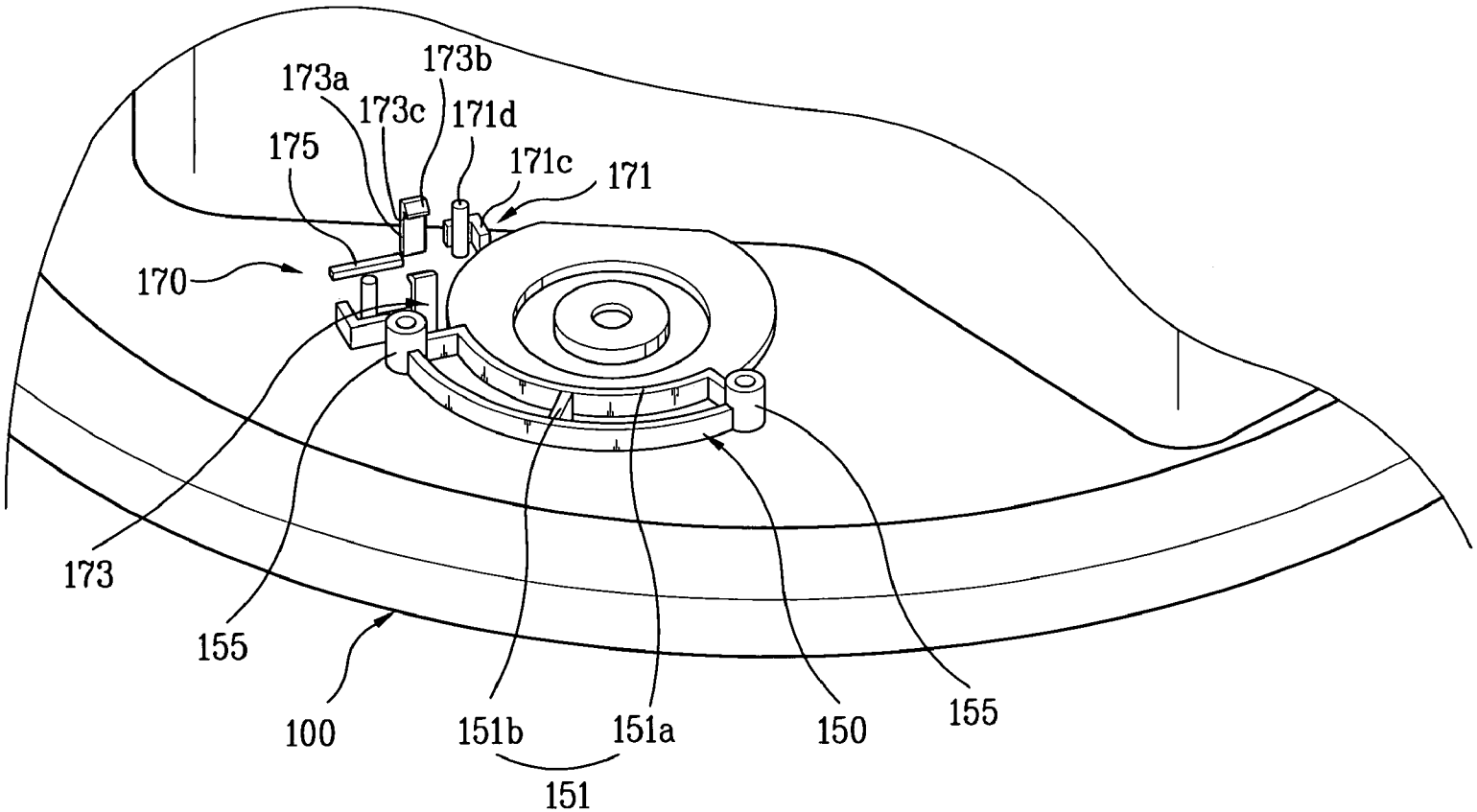
FIG. 10 illustrates a partial enlarged view of an outside structure of a sump having a flow passage control valve mounted thereon.

A structure in which the valve control device is mounted on an outside of the sump of the dishwasher will be described, with reference to FIG. 10.

Formed on an outside of the sump 100, there are a motor mounting part 150 for securing the motor of the flow passage control valve thereto, and a switch mounting part 170 for securing the switch of the motor thereto. The switch and the motor are mounted adjacent to each other, for positioning the lever (not shown) of the switch within a range of contact with the cam (not shown) on the motor.

The motor mounting part 150 has a shape of a section of a ring with predetermined center angle and thickness. The motor mounting part 150 includes reinforcing ribs 151 for increasing strength of an outside of the sump, and motor fastening bosses 155 for securing the motor to the sump.

The reinforcing ribs 151 form a rim of the motor mounting part, and have rim supporting walls 151*a* projected to an outside of the sump with a predetermined width, and a middle supporting wall 151*b* connected between the rim supporting walls 151*a*. It is preferable that there is at least one middle supporting wall 151*b*.

The motor fastening bosses 155 are at predetermined positions of the reinforcing ribs 151, and have female thread parts, respectively. It is preferable that the motor fastening bosses are projected longer than the reinforcing ribs. Moreover, it is preferable that there is at least one motor fastening boss 155.

The switch mounting part 170 includes a positioning part 171 for positioning the switch at the time of mounting, and a locking part 173 for locking the switch after mounting the switch.

It is preferable that the switch mounting part 170 has a supplementary positioning part 175 for supplementing positioning of the switch at the time of mounting the switch. The switch mounting part may have a separate fastening part for securing the switch to the sump, i.e., fastening means of screws, or bolts/nuts.

The switch positioning part 171 includes a positioning guide 171*d* and a guide wall 171*c* for positioning the switch at the time of mounting the switch, and supporting the switch after the switch is mounted.

The locking part 173 includes a body 173*a* for being brought into contact with a side of the switch, a sloped part 173*b* at a top of the body, and a holding part 173*c* at the end of the sloped part.

The supplementary positioning part 175 has a shape of a projection in complementary to a switch groove (not shown) in one side of the switch. The supplementary positioning part 175 supplements positioning of the switch at the time of mounting the switch, and supports the switch after the switch is mounted.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As has been described, the dishwasher of the present invention has the following advantages.

First, the flow passage control device which can perform upper part washing and lower part washing alternately permits to control a flow direction of the washing water effectively, to prevent waste of the washing water.

Second, a flow passage control device can be mounted easily for controlling a flow direction of the washing water.

What is claimed is:

1. A dishwasher comprising:

a sump for holding washing water;

a flow passage control valve rotatably mounted inside the sump for controlling a flow direction of the washing water; and a valve control device for controlling rotation of the flow passage control valve within a predetermined range of angles;

a packing member between the flow passage control valve and the valve control device;

wherein the flow passage control valve includes an upper plate, a lower plate spaced from, and positioned under the upper plate, ribs connected between the upper plate and the lower plate, and a valve coupling boss for coupling to the valve control device; and wherein the sump includes a valve mounting part on an inside for mounting the flow passage control valve thereon, there is a recess on an inside of the valve mounting part for placing the packing member therein.

2. The dishwasher as claimed in claim 1, wherein at least one of the ribs has a width greater than the width of the main flow passage through which the washing water flows.

3. A dishwasher as claimed in claim 1, wherein the valve control device includes:

a motor for driving the flow passage control valve, and a switch and a cam for controlling the motor.

4. The dishwasher as claimed in claim 3, wherein the cam has a shaft pass through hole for passing through of a motor shaft of the motor.

5. The dishwasher as claimed in claim 4, wherein the motor shaft is passed through the shaft pass through hole, joined with the valve coupling boss, such that the motor shaft rotates as a unit with the cam and the flow passage control valve.

6. The dishwasher as claimed in claim 3, wherein the cam includes a first circumferential surface and a second circumferential surface to be brought into contact with a lever of the switch.

7. The dishwasher as claimed in claim 6, wherein the first circumferential surface has a radius smaller than a radius of the second circumferential surface.

8. The dishwasher as claimed in claim 3, wherein the sump includes a motor mounting part projected from an outside surface of the sump for mounting the motor thereon.

9. The dishwasher as claimed in claim 8, wherein the motor mounting part is adjacent to the switch mounting part for mounting the switch thereon.

10. The dishwasher as claimed in claim 9, wherein the motor mounting part includes:

reinforcing ribs for increasing strength of an outside of the sump, and motor fastening bosses for securing the motor to the sump.

11. The dishwasher as claimed in claim 10, wherein the reinforcing ribs include:

rim supporting walls projected from the sump to an outside thereof, and a middle supporting wall connected between the rim supporting walls.

12. The dishwasher as claimed in claim 10, wherein the motor fastening bosses are at predetermined positions of the reinforcing ribs, and projected longer than projection lengths of the reinforcing ribs.

13. The dishwasher as claimed in claim 1, wherein the packing member has a coupling boss pass through hole for placing the valve coupling boss therein, and pleats in a context surface thereof with the packing member.

14. The dishwasher as claimed in claim 1, wherein the recess is formed stepped down from the valve mounting part, and has a hole therein for placing the valve coupling boss therein.

15. The dishwasher as claimed in claim 14, further comprising a housing mounting groove at an outer circumference of the valve mounting part having a shape in complementary to a lower housing over the sump.

16. A dishwasher comprising:

a sump for holding washing water;

a flow passage control valve rotatably mounted inside the sump for controlling a flow direction of the washing water; and a valve control device for controlling rotation of the flow passage control valve, wherein the valve control device comprises a cam that rotates the flow passage control valve within a predetermined range of angles;

a packing member between the flow passage control valve and the valve control device;

wherein the flow passage control valve includes an upper plate, a lower plate spaced from, and positioned under the upper plate, ribs connected between the upper plate and the lower plate, and a valve coupling boss for coupling to the valve control device and wherein the sump includes a valve mounting part on an inside for mounting the flow passage control valve thereon, there is a recess on an inside of the valve mounting part for placing the packing member therein.

* * * * *